US005816875A

United States Patent [19]

Bixby

[11] Patent Number: 5,816,875

[45] Date of Patent: Oct. 6, 1998

[54] FREE FLOW SHAFT-STRINGER

[76] Inventor: John Anthony Bixby, 1287 Virginia Way, La Jolla, Calif. 92037

[21] Appl. No.: 584,607

[22] Filed: Jan. 11, 1996

[51] Int. Cl.[6] ..... B63B 35/79

[52] U.S. Cl. ..... 441/74; 114/125

[58] Field of Search ..... 441/74, 79, 65; 114/39.2, 121, 124, 125; 440/8, 9, 11, 22

[56] References Cited

U.S. PATENT DOCUMENTS 3,254,622 6/1966 Bramson ..... 440/22

4,867,721 9/1989 Fisher ..... 114/125

FOREIGN PATENT DOCUMENTS

WO 95/15882 6/1995 WIPO ..... 440/22

*Primary Examiner*—Ed L. Swinehart

*Attorney, Agent, or Firm*—Frank G. Morkunas

[57] ABSTRACT

A hollow shaft (10) capped at both ends (60*a*/*b*) contains a fluid (40) encompassing approximately half the volume of the shaft. The shaft is inlaid to a cavity (50), fitting snugly into a wood stringer (20). When stringer is assembled for shapable mode, foam blanks (30*a*/*b*) have been glued to it for a workable product.

4 Claims, 1 Drawing Sheet

FREE FLOW SHAFT-STRINGER

BACKGROUND—FIELD OF INVENTION

This invention relates to surfboard design, specifically stringer design that will enhance board riding performance.

BACKGROUND—DISCUSSION OF PRIOR ART

Previously in surfboard design, the stringer has taken a back seat in design evolution. In the last few decades the stringer has experienced limited manipulation by shapers. Its expanded purpose has been overlooked by industry manufacturers. Till this date the sole purpose is to provide structure and strength. These purposes are typical in all surfboards manufactured today.

Foam sheets glued to wood centerlines or "stringers" is the common method of manufacturing shapable blanks. The method is simple and the purpose is basic, yet crudely efficient. However, the stringer is unevolved with regard to the revolutionary advantages it offers after modification.

No prior art is detectable in this arena to match the motion of evolution that this proposed design creates. Instead of the stringers stagnate stable purpose, innovation has introduced the realms of kinesthetic dynamics and fluid motion, into stringer design which will revolutionize avenues for further development.

Accordingly objects and advantages of my invention revolutionize all previous concepts revolving around surfboard stringer construction. Further it creates new realms that will be explored through some basic modifications that will enhance surfboard riding and potentially effect other similar water craft.

Specifically this high performance stringer construction is revolutionary and innovative in purpose, because through a self contained structure in the stringer, it generates momentum. Generation of momentum through water equates to favorable byproducts in surfing such as projection, acceleration, and deeper concentrated drive.

The primary purposes of strength and structure are still preserved while a multitude of dynamic forces are introduced to what was previously a stable, stagnate piece of equipment. Through the self contained momentum potential in the stringer, this product will take performance and design to new levels. Never before has stringer construction been explored in this capacity. More accurately surfboard design has never been explored in this realm. Design innovation has always come from the exterior most commonly in curvature, length, edges and exterior attachments. Never before has surfboard design made attempts at innovation through the capacity for energy that is creatively, harnessed by the present invention. Further objects and advantages of my invention will become apparent from a consideration of the drawings and ensuing description.

REFERENCE NUMERALS IN DRAWINGS

Figure 1:
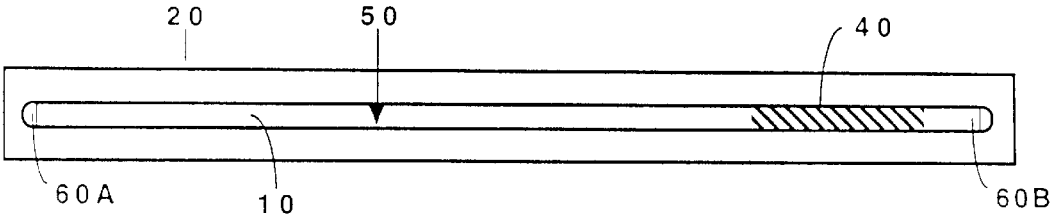
FIG. 1. is a side interior view of the hollow member structure in the wood stringer.

10 shaft
20 stringer

30 [*a*/*b*] foam
40 fluid
50 cavity
60 [*a*/*b*] plugs

SUMMARY OF INVENTION

An improved stringer in a water board having blanks attached to the stringer, whereby the stringer has a longitudinal cavity which receives a hollow member, the member being closed at its ends and which itself contains a fluid substance. The amount of fluid substance is less in volume than the total volume of the hollow member and is adapted to move back and forth within the container as the water board rocks and pivots in use. Additional features of the improved stringer include the following:

Stringer provides primary purposes in construction by meeting the needs of structure and strength.

The stringer expands on primary needs by concealing a self contained apparatus which generates momentum and accents the kinesthetic dynamics involved in surfboard riding.

The stringer enhances trim (lateral movement) through weight distribution.

Provides greater depth and rail commitment when fluid has concentrated at the tail in the shaft of the stringer.

Provides acceleration and projection when stringer shaft fluid transfers weight to the nose.

Realms of fluid dynamics, weight distribution, inertia, and kinesthetic dynamics, all become manipulable, applicable concepts for surfboard riding and design exploration.

DESCRIPTION OF INVENTION

FIG. 1 is an internal side view of the present invention. It represents a wood stringer with an inlaid shaft containing fluid.

The wood stringer 20 (FIG. 1) is cut from desired material to include the length from nose to tail of the finished product. Thickness and width are also taken into account and gauged by needs of shaper or design specifications. Design specification also determines how much curve or rocker is cut. This procedure is basic and universal.

The most major modification occurs when the stringer 20 (FIG. 1) is routed out. After the stringer is cut for design, a portion running through the center and parallel to the top and bottom of the stringer is cut out. This creates a longitudinal cavity within the stringer.

This cut is made to create a cavity 50 (FIG. 1) for the shaft 10 (All Figures) to fit snugly within it. The shaft is the premier modification to the stringer that gives it its originality and high performance declaration for design and marketability. The shaft is constructed of plastic or graphite, may be rigid or flexible, and may be approximately three quarters of one inch in diameter. The shaft structure is capped or closed at both ends 60*a*/*b* (All Figures). Inside the shaft is a liquid or fluid element or substance 40 (All Figures) that is sealed in by 60*a*/*b*. Although more or less fluid may be used, in the preferred embodiment the volume of this fluid encompasses roughly half the empty spacious volume of the shaft.

For completion of this design to be put to use parts 30*a*/*b* (FIG. 3) are glued parallel to the present invention.

Figure 2:
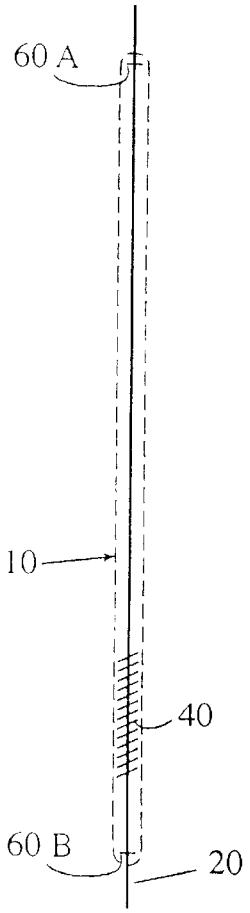
FIG. 2. is a top view of the hollow member, with interior exposed, in a thin stringer.
Figure 3:
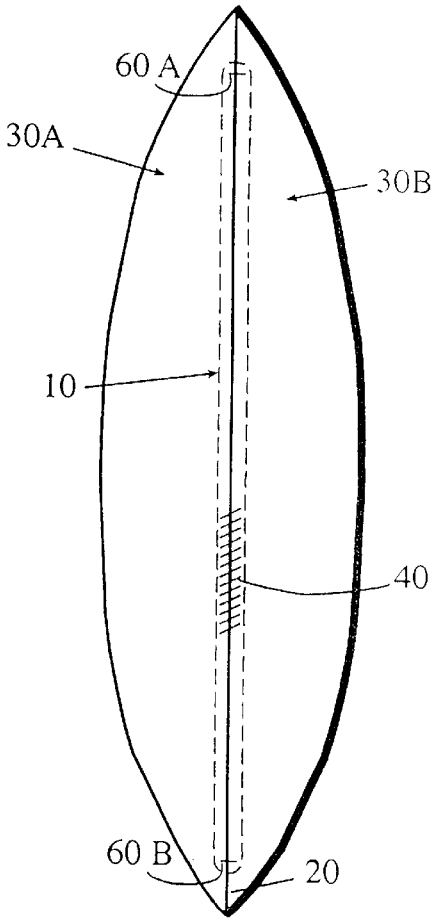
FIG. 3. is a top view of the hollow member shown in FIG. 2 housed within foam blanks on a stringer.

Operation of Invention: FIGS. 1, 2, 3

Use of the complete potential of the present invention becomes manipulable upon attainment of the finished product. When a shaped (foam) surfboard blank is fiberglassed and prepared for riding, it is then the full interactive experience begins to operate.

Beneath the glass shell, in between the foam sides (FIG. 3, 60*a*/*b*) lies the modified stringer (All Figures). Inside the stringer is where the manipulable realms of kinesthetic dynamics originate. The shaft (All Figures) is the housing for a fluid 40 that encompasses approximately half the internal volume of the shaft.

At this origin the board rider can manipulate the dynamic range of internal motion available from the housed fluid 40. The internal motion of the fluid is what creates the energy potential translating to physical displays of momentum, acceleration, projection, and enhanced depth and drive.

In surfboard riding, use of the present invention will require no specific adjustments to manipulate its functions. However, the subtleties of its manipulable range deserve exploration to fully maximize its broad range of application.

Namely, the oscillation of fluid 40 within the shaft 10 creates the effect of an internal wave enhancing the actual wave being ridden. This is largely due to the weight distribution factors. In an acceleration mode, when the fluid has rushed to the nose of the board, and body, weight is stable on the tail, concentration of friction is along the rail of the board connected to the face of the wave. This is commonly referred to as "on edge". Being on edge is magnified by the weight distribution at opposite ends. The sensation of the physical dynamics is similar to the release of a swinging pendulum.

This sensation is a highly favorable accent to some specific positions in wave riding. For example in big wave riding, when paddling into a big wave the lift begins to put the rider in a near vertical position at the top of the wave. The rider stands up toward the tail of the board as the vertical wall shapes and gravity pulls the rider down the face of the wave. At this time the majority of connection is at the inside rail. The vertical position and downhill slope of the wave create enough angle for gravity to work inside the stringer, at which time the fluid rushes to the nose of the board. This boost is fully engaged at the bottom of the wave when the rider begins to make the turn to outrun the avalanche of water. This momentum created off the drop accented by the inertia within the board gives a deeper rail commitment through the bottom turn. As the tail unweights after the turn momentum has translated to another favorable byproduct that hurls the rider further out to the safe flats. This dynamic translation of energy from the bottom of the wave is referred to as projection.

Another specific example of the applicability to the high performance claim of this stringer in wave riding is demonstrated through a common position experienced in longboard surfing.

When surfing smaller waves that break laterally to the shore, many surfers choose to ride a wide, full model often referred to as a longboard. When a surfer is gliding laterally to shoreline across the face of the wave a maneuver known as "a stall" is often executed. A stall is the surfers attempt at burying the tail to slow the speed of the board, create rail and tail depth, and often provides the rider an opportunity to reposition their body to conform to the breaking part of the wave. The stall is an attempt to allow the breaking part of the wave time to catch up. Often the stall is used as a manner to set up for what is known as a tube ride. The slowing down, and burying of the rail allows the throwing portion of the wave to cover the rider completely in a spinning water cylinder. Depth is always desirable in this lodged position. A rapid exit to the shoulder of a wave is the safest way out of a closing tube.

The present invention comes to play quite efficiently for this matter; namely stalling and the tube ride. The desirable dynamics are relatively the same in both positions. The fluid element 40 in the shaft 10 exhibits the same patterns in both maneuvers. When the rider buries the tail while using the present invention, they create a fluid rush to the tail of the board. The concentrated weight at the tail enhances its depth. This not only deepens the tail rail in the face of the wave but also has the potential to help the rider get back further in the tube with a more committed position. Generally riders work for deep tube rides.

The most valuable tool for getting out of a deep stall or fade in the tube is ability to accelerate. Often times surfers don't make deep tube rides contrary to their desire. They get engulfed by the white wash due to lack of rail commitment (loss of friction) or inability to smoothly accelerate. The Shaft-Stringer of the present invention solves both of these problems.

Considering that a buried tail rail slows the board and rear shaft fluid 40 enhances depth, acceleration is imperative. The modified stringer is a valuable tool when acceleration maneuvering is required. As discussed in the first part of this section, fluid flow to the nose generates momentum. In lateral surfing, flow from the tail to the nose subtly creates the leverage needed to maximize rail connection. The combination of a connected tail rail and increasing weight in the nose (unweighted tail) blends the friction necessary for smooth down the line speed, hence acceleration.

In retrospect, the cited positions typically displayed in surfing provide excellent examples for the range of constructive fluid flow that the proposed stringer integrates with board riding.

Summary, Ramifications, and Scope

Accordingly, the reader can see that the shaft-stringer combination of the present invention provides an evolved stringer application, and a tremendous range of manipulable dynamic potential through fluid flow. In addition, the primary purpose of strength and structure stay intact. Furthermore, this Shaft-Stringer displays a continued array of function and modification pertinent to this invention. The shaft-stringer combination:

- Is applicable to shortboard, longboard, and big wave surfboards; available and corresponding to design specifications.
- Incorporates the manipulable realms of momentum, projection, and acceleration.
- Provides the primary purposes of strengthening and structure.
- Accents the kinesthetic dynamics natural to surfboard riding.
- Enhances weight distribution byproducts including drive, trim, and unweighting.
- Is a revolutionary evolution in design innovation because it transfers focus to the core of surfboards to explore physical dynamics, as opposed to typical exterior structural modifications.

Although the description above contains many specific sites, these should not be construed as limiting the scope of the invention but as merely providing illustrations of some of the presently preferred embodiments of this invention. For example, the shaft can have a variety of shapes, gauges, lengths, or volume variations. The fluid can also be accented or replaced by solid moving structures. Possibly the shafts need not be housed by the stringer. It is even possible for the shaft to not be a closed system, but rather user accessible.

Thus the scope of the invention should be determined by the appended claims and their legal equivalents, rather than by the examples given.

I claim:

1. In a water board having a stringer, an improved stringer comprising:

a. a longitudinal cavity within said board;

b. a hollow stringer member within said cavity, said member having at least two ends and being closed at said ends; and c. a fluid substance within said hollow member, said fluid substance being less in volume than a total volume of said hollow member, thereby permitting said fluid substance to move back and forth within said hollow member.

2. The invention as defined in claim 1 wherein said stringer is a wood stringer.

3. The invention as defined in claim 1 wherein the volume of said fluid substance is approximately between 10–90% of the total volume of said hollow member.

4. The invention as defined in claim 1 wherein the volume of said fluid substance is approximately between 40–60% of the total volume of said hollow member.

* * * * *

UNITED STATES PATENT AND TRADEMARK OFFICE

CERTIFICATE OF CORRECTION

PATENT NO : 5,816,875

DATED : Oct. 6, 1998

INVENTOR(S) : John Anthony Bixby

It is certified that error appears in the above-identified patent and that said Letters Patent is hereby corrected as shown below:

Column 5, line 4, delete the word "board" and insert the word --stringer--

Column 5, line 5, delete the word "stringer"

Signed and Sealed this

Twenty-ninth Day of December, 1998

*Attest:*

Bruce Lehman

BRUCE LEHMAN

*Attesting Officer*

*Commissioner of Patents and Trademarks*